US009700182B2

(12) United States Patent
Binderbauer et al.

(10) Patent No.: US 9,700,182 B2
(45) Date of Patent: Jul. 11, 2017

(54) LIQUID DISPENSER

(71) Applicant: SOAPTRONIC INTERNATIONAL, LLC, Lake Forest, CA (US)

(72) Inventors: Horst Binderbauer, Lake Forest, CA (US); Renato S. Franchetto, Laguna Beach, CA (US); Drew S. Abejon, Irvine, CA (US)

(73) Assignee: SOAPTRONIC INTERNATIONAL, LLC, Lake Forest, CA (US)

( * ) Notice: Subject to any disclaimer, the term of this patent is extended or adjusted under 35 U.S.C. 154(b) by 0 days.

(21) Appl. No.: 14/829,365

(22) Filed: Aug. 18, 2015

(65) Prior Publication Data

US 2016/0183740 A1 Jun. 30, 2016

Related U.S. Application Data

(63) Continuation of application No. 12/941,736, filed on Nov. 8, 2010, now Pat. No. 9,301,654.

(51) Int. Cl.
*A47K 5/12* (2006.01)

(52) U.S. Cl.
CPC ..... *A47K 5/1217* (2013.01); *A47K 5/1211* (2013.01); *A47K 5/1214* (2013.01); *A47K 2005/1218* (2013.01)

(58) Field of Classification Search
CPC .. A47K 5/1217; A47K 5/1211; A47K 5/1214; A47K 2005/1218
USPC ..... 222/52, 108, 185.1, 181.3
See application file for complete search history.

(56) References Cited

U.S. PATENT DOCUMENTS 1,497,716 A * 6/1924 Fawcett ..... A47K 5/10 222/161
1,734,821 A 11/1929 Miller
2,387,359 A 10/1945 Scarry
2,457,531 A * 12/1948 Costakos ..... G01F 11/32 141/293
2,552,817 A 5/1951 Ross
2,670,105 A 2/1954 Huhn
3,273,752 A 9/1966 Davy
3,955,713 A 5/1976 Hurley
4,489,840 A 12/1984 De Freitas
4,715,269 A 12/1987 Stoner
4,784,616 A 11/1988 Zimmermann
4,921,131 A 5/1990 Binderbauer et al.
4,993,593 A 2/1991 Fabiano et al.
5,235,214 A 8/1993 Vuong et al.
5,305,916 A 4/1994 Suzuki et al.
5,538,163 A 7/1996 Dassi
(Continued)

OTHER PUBLICATIONS

EP, 14195292.9 Search Report, Mar. 18, 2015.
WO, PCT/US2011/057760 ISR, Aug. 10, 2012.
WO, PCT/US2011/057760 IPRP, May 14, 2013.

*Primary Examiner* — Donnell Long
(74) *Attorney, Agent, or Firm* — ONE LLP

(57) ABSTRACT

A sanitary liquid dispenser having a spherical housing with a discharge port and a fluid reservoir positioned within the dispenser. The fluid reservoir includes a disposable deformable bag with a nozzle projecting downwardly from the bag. The dispenser includes a proximity detector for activating a discharge mechanism when detecting the proximity of an object beneath the dispenser. The discharge mechanism includes a valve within the nozzle.

17 Claims, 7 Drawing Sheets

(56) References Cited

U.S. PATENT DOCUMENTS

| | | | | |
|---|---|---|---|---|
| 5,678,733 | A | 10/1997 | Ong | |
| 6,102,253 | A * | 8/2000 | Gallina | A47K 5/10 222/181.3 |
| 6,209,751 | B1 | 4/2001 | Goodin et al. | |
| 6,609,311 | B2 | 8/2003 | Hagemann et al. | |
| 6,711,990 | B1 | 3/2004 | Harrison | |
| 6,820,770 | B2 | 11/2004 | Makino et al. | |
| 7,753,545 | B2 | 7/2010 | Groover | |
| 8,109,411 | B2 | 2/2012 | Yang et al. | |
| 2004/0226962 | A1 | 11/2004 | Mazursky et al. | |
| 2005/0045671 | A1 | 3/2005 | Beesley et al. | |
| 2007/0007304 | A1 | 1/2007 | Bitton | |
| 2009/0140004 | A1 | 6/2009 | Scorgie | |
| 2011/0030846 | A1 | 2/2011 | Vandamme et al. | |

* cited by examiner

FIGURE 8
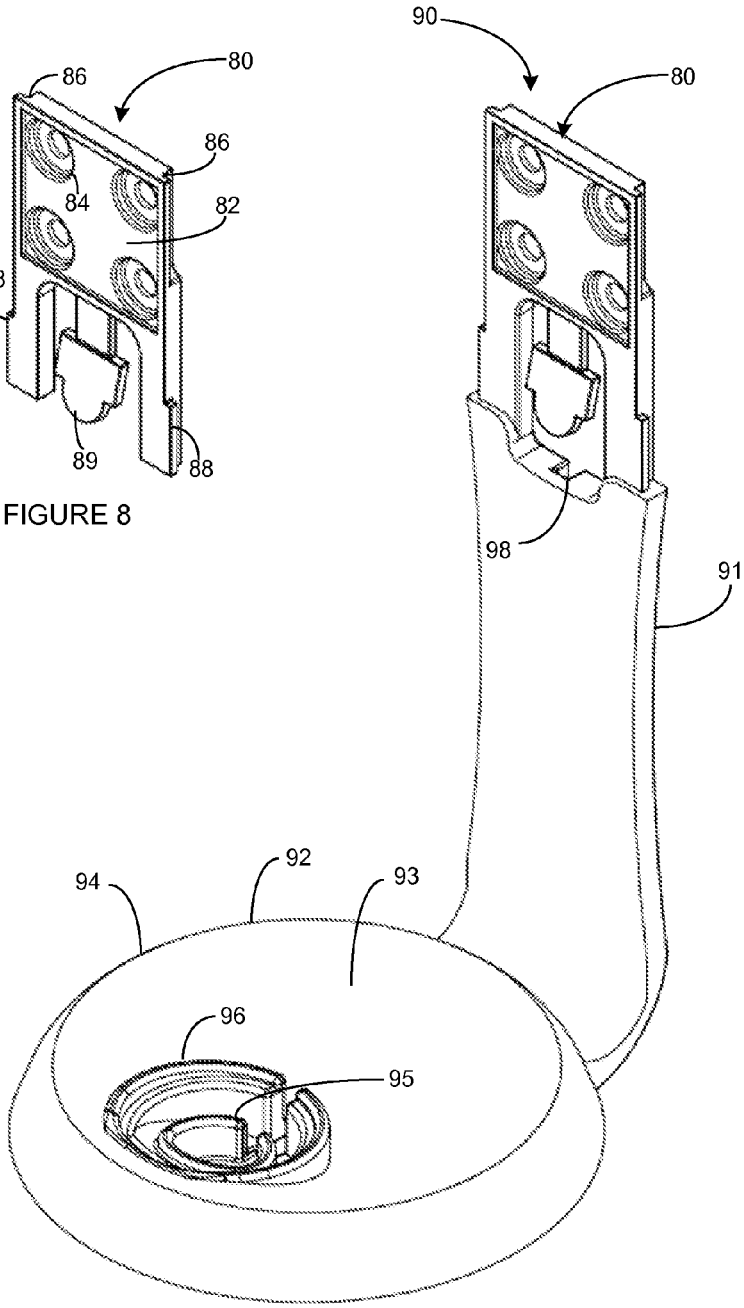
FIGURE 9
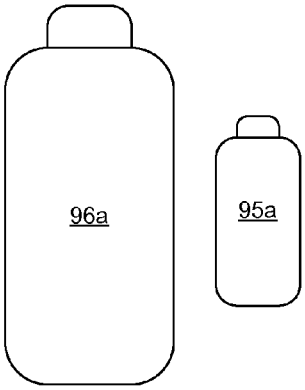
FIGURE 10

LIQUID DISPENSER

CROSS-REFERENCE TO RELATED APPLICATIONS

This application is a continuation application of U.S. patent application Ser. No. 12/941,736, filed Nov. 8, 2010, which application is incorporated herein by reference.

FIELD

The subject matter described herein relates generally to liquid dispensers, and more particularly to liquid dispensers that facilitate the dispensing of soaps and sterile cleansing fluids such as antiseptic soaps and sterilizing solutions.

BACKGROUND

Fluid dispensers have heretofore been known. Illustrative examples of fluid dispensers are those disclosed in U.S. Pat. Nos. 2,387,359 and 3,273,752. The proposed dispenser in these and other patents have covered a wide range of features attempting to contribute to the more effective distribution of ordinary cleansing fluids such as soap and to the sterile dispensation of cleansing fluids for use in various environments such as hospitals, food processing establishments, and the like where use of sterile fluids is required. In such environments there is often contamination of the hands with infectious materials, and use of a contaminated hand to actuate a dispenser can result in placing such infectious material on the dispenser and even result in the infectious organisms in such materials contaminating the cleansing fluid in the dispenser.

Also, in such environments the flow of air can carry infectious organisms and trap them in nooks and crannies of the dispensers where they can again present contamination problems.

Further, while many soaps and solutions are initially sterile when placed in a dispenser, there are no sure means provided to ensure their sterility during use. Proposals in the noted patents and in other devices to overcome contamination problems have included features such as proximity actuation (i.e., actuation without actually touching a control or actuating member), and efforts to seal the cleaning fluids from the ambient contaminating environment.

U.S. Pat. No. 4,921,131 discloses an illustrative example of a dispenser that embodies a number of features which are deemed necessary and/or desirable to ensure continued dispensing of sterile cleaning fluids over an extended period of time.

Use of such dispensers has tended to be concentrated in environments such as hospitals, food processing establishments, and the like. The home, however, is also an environment in which there is often contamination of the hands from infectious materials or where individuals enter with hands already contaminated.

Accordingly, there continues to be a need for further improvement in dispenser apparatuses for use in the home and the like.

SUMMARY

Embodiments described herein are directed to an improved liquid dispenser adapted for the dispensation of sterile fluids which are subject to a minimum risk of contamination. The liquid dispenser includes a spherical housing with an upper and a lower hemisphere, a discharge port formed in the lower hemisphere, and a fluid reservoir positioned within the housing. The fluid reservoir includes a disposable deformable solution bag with a nozzle projecting downwardly from the bag. The dispenser includes a proximity detector for activating a discharge mechanism when detecting the proximity of an object beneath the dispenser. The discharge mechanism includes an electric actuated valve within the nozzle and valve actuator.

In one embodiment, the dispenser includes a wall mount drip tray. In an alternative embodiment, the dispenser includes a table stand couplable to the wall mount drip tray.

In another embodiment, the dispenser includes a night light which comprises a LED that illuminates the solution bag and the inside of the upper hemisphere of the spherical housing which comprises a translucent dome.

In yet another embodiment, the dispenser includes a sliding cover for an AC/DC plug that serves as a clip-in holder for the plug, and aligns the plug automatically when the cover is slid back into a slot in a dispenser base.

In another embodiment, a refill button is used to fill bottles with liquid from the solution bag by continuously activating the discharge mechanism.

Other objects, systems, methods, features, and advantages of the invention will be or will become apparent to one with skill in the art upon examination of the following figures and detailed description. It is intended that all such additional systems, methods, features and advantages be included within this description, be within the scope of this invention, and be protected by the accompanying claims. It will be understood that the particular methods and apparatus are shown by way of illustration only and not as limitations. As will be understood by those skilled in the art, the principles and features explained herein may be employed in various and numerous embodiments.

DESCRIPTION OF THE DRAWINGS

The details of the invention, both as to its structure and operation, may be gleaned in part by study of the accompanying figures, in which like reference numerals refer to like parts. The components in the figures are not necessarily to scale, emphasis instead being placed upon illustrating the principles of the invention. Moreover, all illustrations are intended to convey concepts, where relative sizes, shapes and other detailed attributes may be illustrated schematically rather than literally or precisely.

FIGS. 8 and 9 are perspective views depicting a wall mount bracket and a wall mount bracket with drip tray.

FIG. 10 are plan views of travel bottles receivable in the drip tray rings for filling with dispenser.

It should be noted that elements of similar structures or functions are generally represented by like reference numerals for illustrative purpose throughout the figures. It should also be noted that the figures are only intended to facilitate the description of the preferred embodiments.

DETAILED DESCRIPTION

Figure 1A:
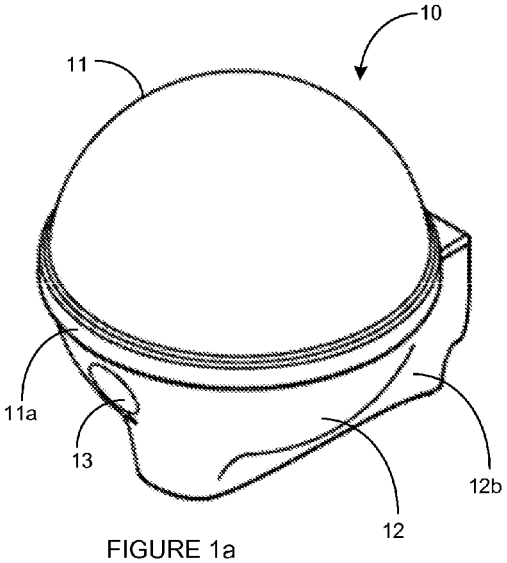
FIGS. 1*a* and 1*b* are perspective views depicting the exterior of the fluid dispenser housing.
Figure 1B:
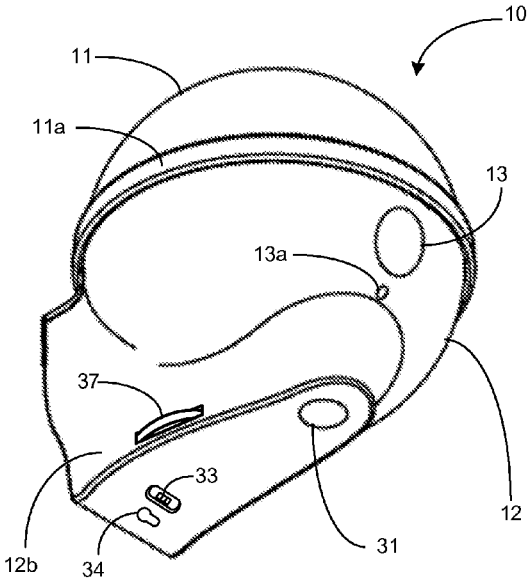
Figure 1C:
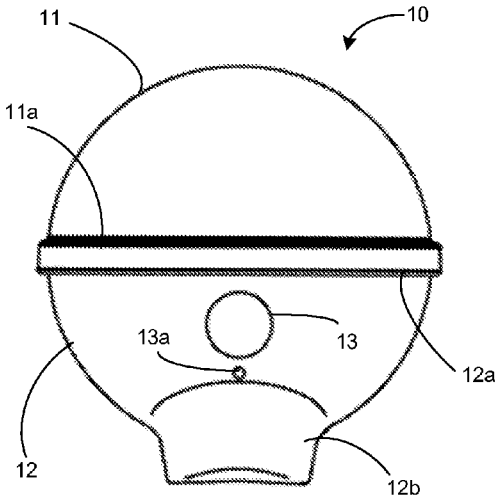
FIGS. 1*c* and 1*d* are front and rear views of the fluid dispenser housing depicted in FIGS. 1*a* and 1*b*.

Embodiments described herein are directed to improved liquid dispensers systems adapted for the dispensation of sterile fluids which are subject to a minimum risk of contamination.

Turning in detail to the figures, and more particularly to FIGS. 1*a*, 1*b*, 1*c* and 1*d* thereof. As depicted, a liquid dispenser 10 preferably comprises a generally spherical housing comprised of an upper hemispherical section or dome cover 11 and a lower generally hemispherical section 12. Projecting from the lower hemispherical section 12 is a base 12*b* with a liquid dispensing port 31 formed in its bottom side. Also projecting from the lower hemispherical section 12 and base 12*b* is a rear mounting bracket 14, which is provided for mating engagement with a wall mount or other support member for support of the liquid dispenser housing assembly 10.

Located toward the front of the lower hemispherical section is a nozzle lock release button 13 which releases a nozzle of a fluid dispensing container or reservoir when depressed as discussed below. In addition, a multi color LED 13*a* is positioned below the nozzle lock release button 13 providing an indication of operating status.

Both hemispheres 11 and 12 are made of impact resistant smooth composition material such as ABS or PC. The upper hemisphere or dome cover 11 is translucent so as to provide for visual observation of the interior contents of the dispenser 10 in order that the level of the fluid within the fluid container or reservoir can readily be seen. As discussed below, an LED is provided to illuminate the dome cover 11 for use as a night light.

The spherical shape of the liquid dispenser housing 10 further contributes to the attractiveness of the assembly by minimizing surfaces that collect dust or contaminates. Curved surfaces are less susceptible to the accumulation of such undesired products than are geometrical configurations having one or more planar surfaces. In this regard, it should be understood that although the upper and lower hemispheres are shown as being joined by flanges 11*a* and 12*a*, such flanges are exaggerated in size in order to add clarity to the drawing, it being contemplated that such flanges, if at all, are but minute enlargements of the thickness of the materials comprising the principal portions of hemispheres 11 and 12 so as to present a minimum of dust and contaminate collecting surfaces. Moreover, it is contemplated that any flanges will be curved (as shown in FIGS. 2 and 3) so as to provide a smooth continuum of surface between themselves and the adjacent hemispherical shapes, thereby avoiding abrupt changes in surfaces that might provide host areas attractive to contaminates.

Figure 2:
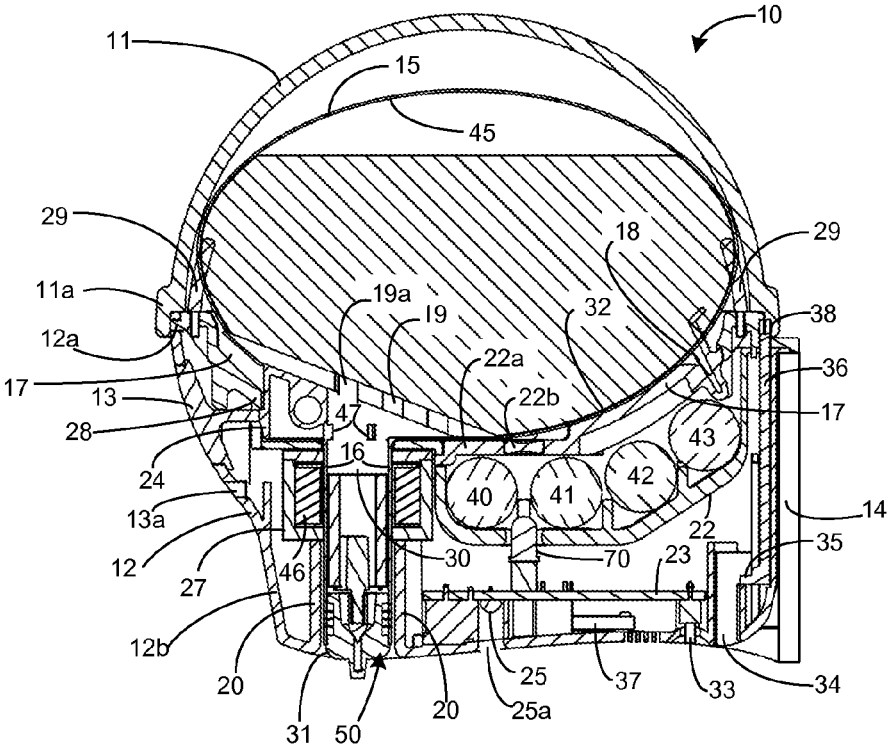
FIGS. 2 and 3 are vertical side cross sections of the fluid dispenser with and without a fluid container disposed therein.
Figure 3:
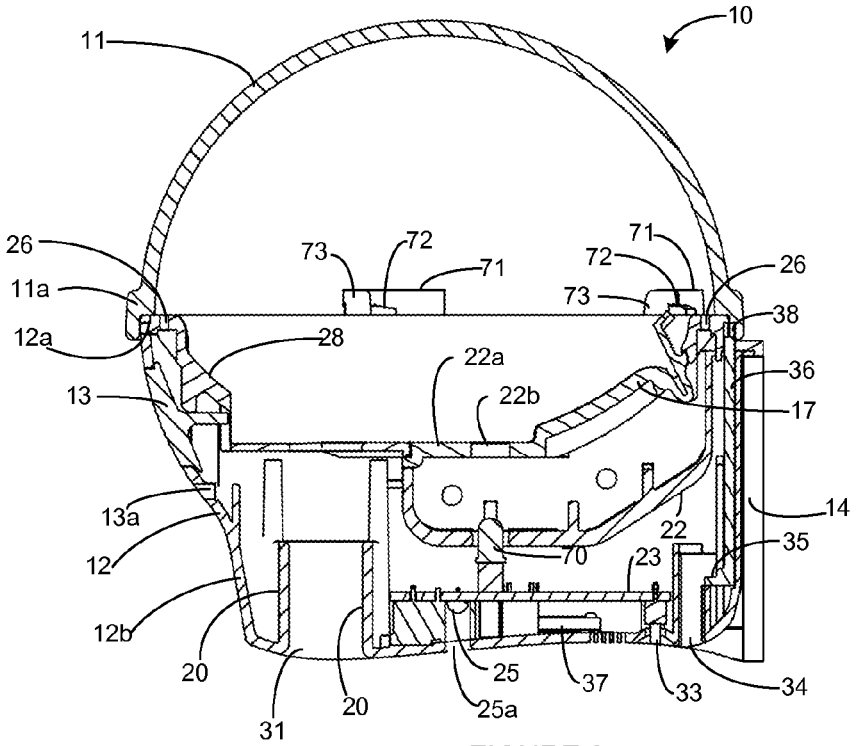

As depicted in FIGS. 2 and 3, the fluid dispensing assembly 10 is seen in a vertical partial side section. The upper hemisphere section 11 is retained in mating association with lower hemisphere section 12 by bayonet type form-fit of mating parts that are engaged by positioning the upper hemisphere 11 onto the lower hemisphere 12 and then twisting the upper hemisphere to fully engage the mating bayonet parts. The bayonet type mating parts include a slot 71 with step 72 formed in the upper hemisphere 11 at a plurality of locations, and a tab 73 receivable in the slot 71 and extending up from the lower hemisphere 12. The hemispheres 11 and 12 are preferably slotted in such a way that they only fit together in one orientation and the upper hemisphere 11 twists clockwise to secure to and counterclockwise to release and separate from the lower hemisphere 12.

The dome cover 11 has a recess 38 adaptable to receive a locking pin 36 that is biased to slide up into the recess 38 after the dome cover 11 is twisted clockwise to its secure orientation. To release the locking pin 36, a plastic key, with a cam surface adapted to engage a tab 35 at the base of the locking pin 36, is inserted into a lock hole 34, which is open on the bottom of the base 12*b* of the dispenser 10 and rotated counterclockwise 90°. While the key is at the 90° orientation, the locking pin 36 is recessed allowing the dome cover 11 to be twisted counter clockwise to release it from the lower hemisphere 12. When the hemispheres 11 and 12 are disengaged, the interior of the dispenser 10 is exposed for the insertion and removal of batteries and a fluid reservoir 15 which contains the fluid to be dispensed.

As depicted in FIG. 2, the fluid reservoir 15 comprises an oval bag, which preferably is constructed of translucent or transparent flexible materials such as thin polyethylene sheet, and positioned within the upper hemisphere 11. The bag 15 is shown in FIG. 2 as being filled with a fluid and as such has its upper surface 45 in a convex curve as shown. As fluid is drained from its interior, its upper surface deforms downwardly. The upper inner surface 45 of the oval bag 15 is made of a readily deformable plastic-like material which not only is translucent or transparent to permit visual observation of its contents, but additionally, is sized so that when bag 15 is completely empty the upper inner surface 45 is lowered to be in contact with the lower inner surface 32 of the bag 15, thereby permitting the bag 15 to be completely emptied.

At a lower portion of the bag 15 toward the front of the bag 15 and the dispenser 10, a rigid annular nozzle base 19 is joined and sealed to the bag 15. The nozzle base 19 includes a central aperture 19*a*. A tubular extension or nozzle 16 extends downwardly from the nozzle base 19. The nozzle 16 may extend as shown, be shorter, or optionally be longer and preferably includes a valve assembly 50 of a discharge mechanism described in detail with regard to FIG. 4.

Figure 6:
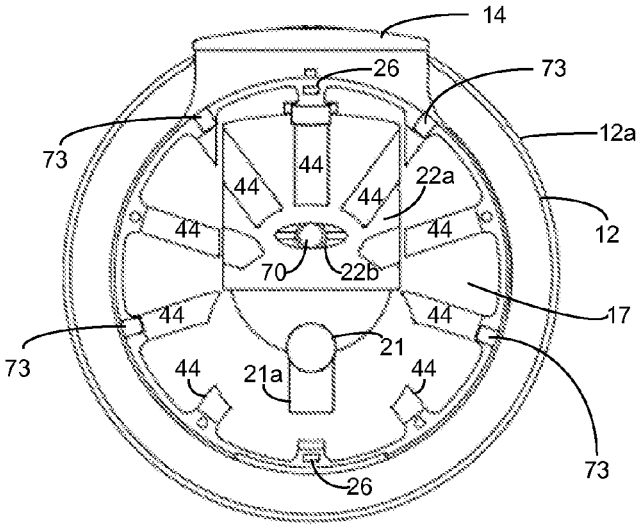
FIG. 6 is a top view depicting the lower hemisphere of the fluid dispenser.

As shown in FIGS. 2, 3 and 6, included within the lower hemisphere 12 is a curved conforming support piece 17, which is bowl-like in shape, so as to provide a conforming surface within which to contain and support the lower portion 18 of the bag 15. Curved supports 44 are molded into the curved plate 17 and placed peripherally about the interior of the lower hemisphere 12 at predetermined angles from each other in order to provide support for the bag 15. The curved support piece 17 includes an aperture 21 and keyway 21*a* which interact with a locking tab 24 protruding from the nozzle 16 and the nozzle base 19 to guide and correctly orient or align the nozzle 16. An upwardly extending rigid tube 20 extending from the bottom of the base 12*b* acts to further guide and support the nozzle 16. A guide ring 29 extends upwardly from the lower hemisphere 12 with tabs 29*a* inserted into slots 26. The guide ring 29 acts to guard against the bag 15 getting pinched between the upper and lower hemispheres 11 and 12.

Included within the lower hemisphere 12 of the dispenser assembly 10 is a battery compartment 22 below the support piece 17. The battery compartment is adapted to receive and support two pairs of conventional dry-cell batteries 40, 41, 42 and 43. Immediately below battery compartment 22 in the base 12*b* is a printed circuit board 23. As shown in FIG. 6, a cover 22*a* to the battery compartment 22 is positioned within a cut out of the support piece 17.

A proximity sensor element 25 is coupled to the circuit board 23 and positioned above a sensor aperture 25*a* formed in the bottom of the base 12*b*. The sensor aperture 25 is positioned spaced away from the exit port 31 approximately the average distance between the center of an adult person's palm and the center of the fingers, thus resulting in liquid being dispensed into the palm of a person's hand.

The lower hemisphere 12 also includes a nozzle lock stop 28 mounted adjacent the nozzle release button 13 and configured to engage the nozzle locking tab 24 extending from the nozzle base 19 and nozzle 16 to automatically lock the nozzle 16 into place after being fully inserted into the dispenser 10. When the nozzle release button 13 is depressed by a user, the locking tab 24, which is of flexible construction, is caused to disengage from the lock stop 28 to enable the bag 15 to be removed from the dispenser 10. The locking tab 24, which protrudes from the nozzle 16, is received in keyway 21*a* of the curved support piece 17.

The discharge mechanism also includes a conventional donut-shaped solenoid 27 located within the lower hemisphere 12 and supported by the rigid tube 20 extending from the bottom of the housing 12*b*. The nozzle 16 extends from the bag 15 through the hollow central portion 30 of the solenoid 27. However, in the alternative embodiment mentioned above, the support tube 20 may be further extended and may contain the valve assembly 50. In such event, the support tube 20 and its included valve assembly 50 would extend through solenoid 27. The solenoid coil 46 is actuated by conventional circuits on the printed circuit board 23 in response to the detection by proximity sensor element 25 of a near by activating element such as a hand.

When the coil 46 of the solenoid 27 is activated, a valve assembly 50 contained within the extension tube or nozzle 16 (described in greater detail with regard to FIG. 4) is actuated, thereby permitting fluid within the bag 15 to exit through the tube extension or nozzle 16 under the force of gravity. Such fluid descends through the tube extension or nozzle 16 and the valve 50 and exits the dispenser 10 at the liquid dispensing port 31.

As shown in FIGS. 1*b*, 2, 3 and 7*a*, the dispenser 10 has a refill button 37 on the left side (when looking at the front of the dispenser 10) of the base 12*b* and coupled to the circuit board 23. When the button 37 is depressed, the solenoid coil 46 is continuously activated to actuate the valve assembly 50 to continuously dispense liquid until the refill button 37 is released. The refill button 37 is used to fill bottles (see FIG. 10) with liquid from the bag 15.

Figure 4:
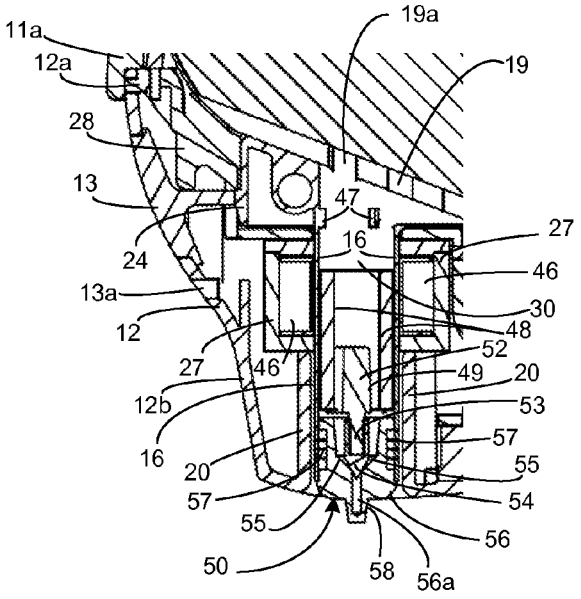
FIG. 4 is an enlarged cross section of the solenoid and valve actuating mechanism of the fluid dispenser.

Turning to FIG. 4, the aforementioned valve assembly 50 is shown in detail. The valve assembly 50, which is shown inserted within the extending tube or nozzle 16, comprises a thin cylindrical iron sleeve 48 coupled to a plastic valve gate support plunger 49. Inset surfaces 47 inset on the interior lumen of the extending tube 16 are provided to act as a limit or stop to the upward movement of the vertically movable sleeve 48. The plunger 49 includes a vertically downward extending plunger base 52. Extending from the lower extremity of the plunger base 52 is a reduced diameter plunger stem 53, onto which there is friction-fitted a resilient valve gate member 54 which is adapted for engagement with a conical valve seat surface 55.

As depicted, the valve 50 is shown in a closed position which occurs when the solenoid 27 is de-energized. When the coil 46 of the solenoid 27 is energized, the vertically movable sleeve 48 and plunger 49 move upwardly toward the inset surfaces 47 drawing the mating surfaces of the valve gate member 54 and valve seat surface 55 apart, thereby opening the valve 50 to allow fluid flow out of the dispenser 10. When the coil 46 of the solenoid 27 is de-energized, the vertically movable sleeve 38 and plunger 49 move downwardly under the influence of gravity until the mating surfaces of the valve gate member 54 contact the mating surfaces of the valve seat surface 55, thereby closing the valve 50.

The valve seat surface 55 is formed in a valve seat block 56, which is press-fit into the extending tube or nozzle 16. The valve seat block 56 may be made of any suitable conventional resilient material (e.g., polyethylene) so long as it does not interact unfavorably with the type of fluid to be dispensed. The valve seat block 56 includes extension flutes 57 which project outwardly as shown from the main body of the valve seat block 56. The flutes 57 are sized for an interference fit within a lower portion of the extending tube or nozzle 16.

Figure 5A:
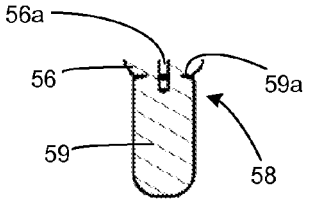
FIG. 5*a* is a partial sectional view of the nozzle tip and valve seat body of the valve mechanism.

The lower end of the valve seat block 56 includes a nozzle tip 58 with a fluid passageway 56*a* extending from the nozzle tip 58 to the valve seat 55. The nozzle tip 58 may be clipped or cut off to open the fluid passageway 56*a* for use. Alternatively, as depicted in FIG. 5*a*, the nozzle tip 58 can include a knob 59 and a reduce diameter region 59*a* between the knob 59 and the valve seat body 56. The knob 59 can be twisted to tear the reduced diameter region 59*a* to open the fluid passageway 56*a* for use.

Figure 5B:
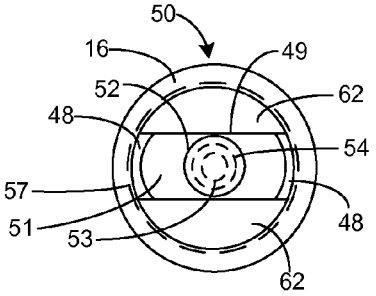
FIG. 5*b* is a partial sectional view illustrating the geometries of the fluid flow passage adjacent the movable element of the valve mechanism.

Turning to FIG. 5*b*, fluid flow passages 62 that extend past the vertically movable sleeve 48 and plunger 49 are shown. As depicted in FIG. 5*b*, the sleeve 48 and a laterally extending portion 51 of the plunger 49 are in slidable engagement with the inner walls of the extending tube 16. The laterally extending portion 51 does not close off the passageway within the extending tube 16. Thus, there is space 62 on either side of the plunger 49 that permits passage of the fluid. Accordingly, ample passageway is provided for the vertical movement of fluid from the bag 15 downwardly through the valve 50 to the fluid passageway 56*a* in the nozzle tip 58.

Figure 7A:
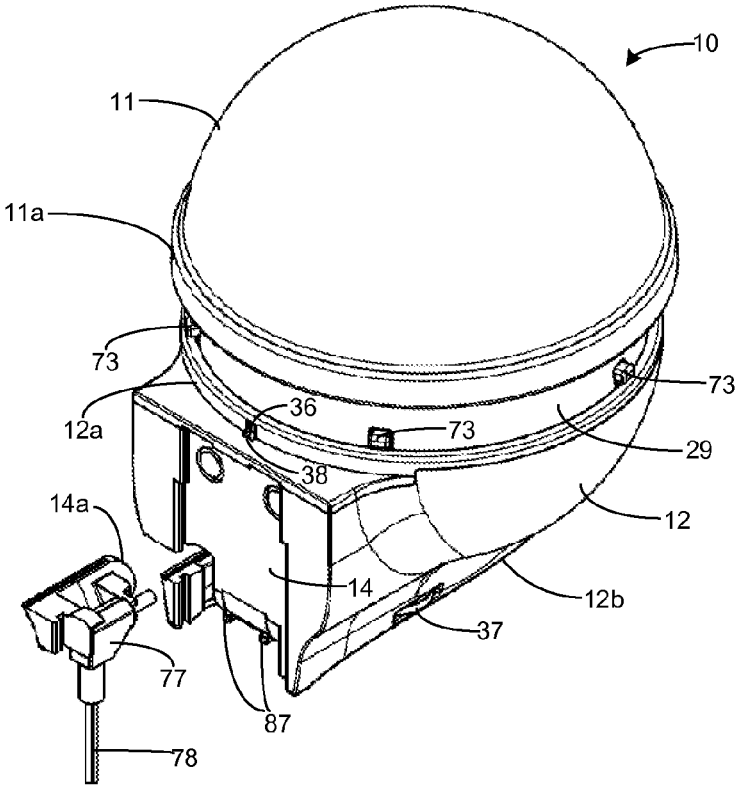
FIGS. 7*a* and 7*b* are partially exploded perspective views of the dispenser with the dome cover shown released from the lower hemisphere and AC/DC plug cover with a plug and cable coupled thereto shown released from the base.
Figure 7B:
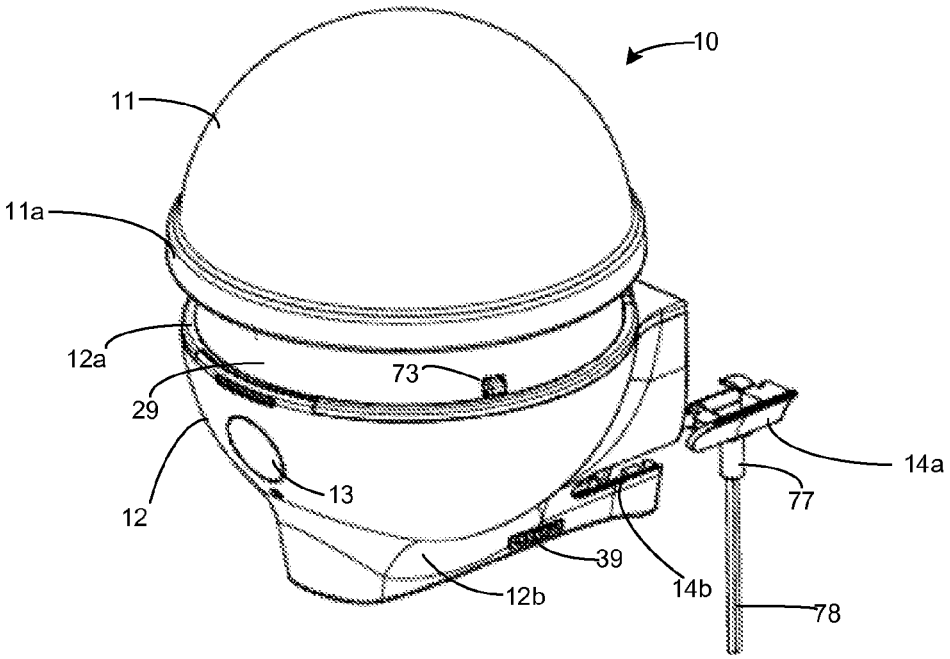
Figure 11A:
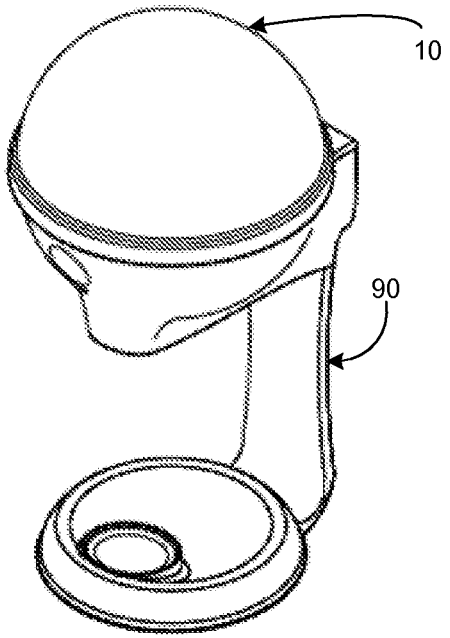
FIGS. 11*a* and 11*b* are perspective views depicting the fluid dispenser housing coupled to the wall mount bracket with drip tray.
Figure 11B:
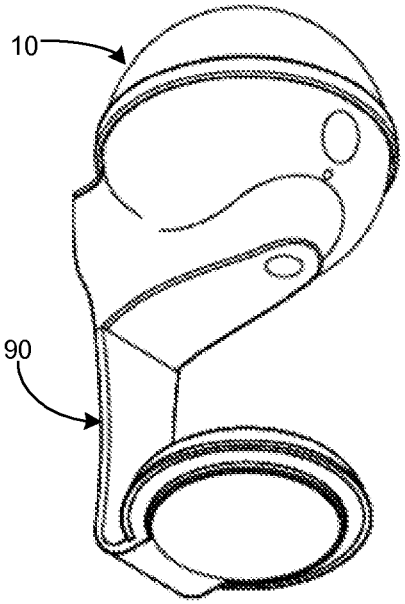
Figure 11C:
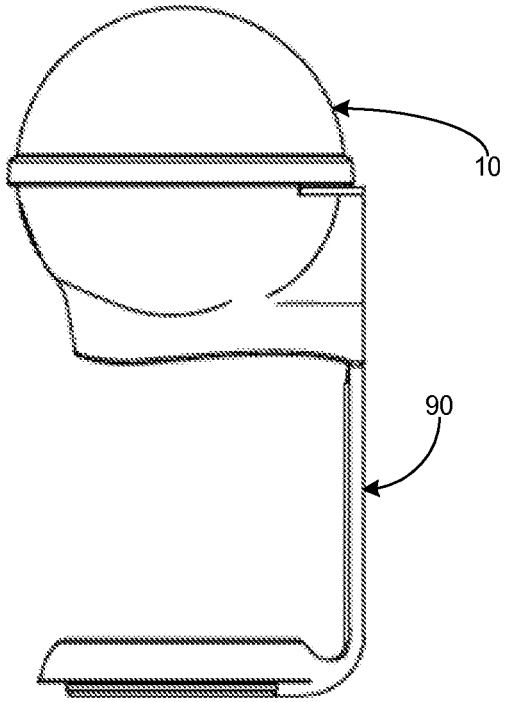
FIGS. 11*c* and 11*d* are side and rear views of the fluid dispenser housing coupled to the wall mount bracket with drip tray depicted in FIGS. 12*a* and 12*b*.
Figure 11D:
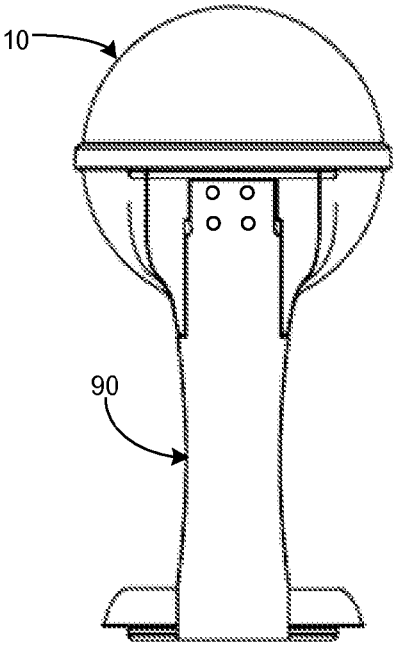

The circuits of the printed circuit board 23 may be generally similar to those of Horeczky U.S. Pat. No. 3,273,752 and additionally include an R-C or other timing circuit that is adjustable to provide a correspondingly timed actuation of solenoid coil 46 which in turn results in a correspondingly adjustable time of liquid dispensing. As depicted in FIG. 7*b*, a liquid portion size adjustment dial 39 is positioned on the right side of the base 12*b* when looking at the front of the dispenser 10 and is coupled to a potentiometer on the circuit board 23 to adjust the dispensing time in a conventional manner. The adjustment dial 39 allows easy portion adjustment for the user and also displays the numbered setting through a window on the bottom of the dispenser 10 (lowest, 1 through highest, 5). The circuits also include a combination low battery and "dispenser activated" visual indicator 13*a* and a conventional adjustable delay reset that prevents undesired multiple dispensations that might otherwise occur if hands are retained in proximity to sensor 25 after a first measure of fluid is dispensed.

The dispenser 10 includes an LED 70 coupled to and extending up from the circuit board 23 and through the bottom of the battery compartment 22. The LED 70 shines through an opening 22*b* in the battery cover 22*a* to illuminate the solution bag 15 and the inside of the translucent dome of the upper hemisphere 11 to act as a night light. The dispenser night light has 3 settings: On, Night-On, or Off, which are adjustable using a switch 33 positioned on the bottom of the base 12*b* and coupled to the circuit board 23.

Figure 1D:
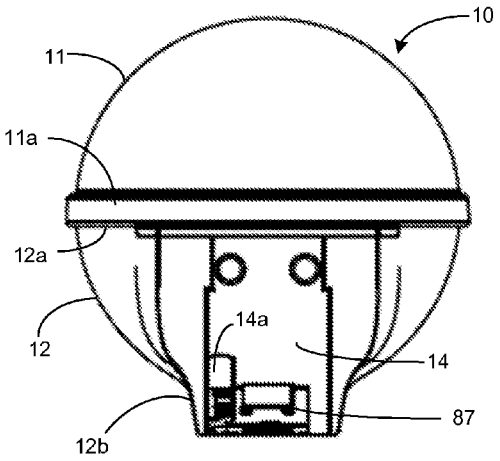

The circuits of the circuit board 23 may be powerable from sources other than batteries, such as, e.g., ordinary AC or DC power sources. As depicted in FIGS. 1*d*, 7*a* and 7*b*, the dispenser 10 includes a sliding cover 14*a*. The cover 14*a* serves as a clip-in holder for an AC/DC plug 77, and aligns the plug 77 automatically with a power port of the dispenser 10 when the cover 14*a* is slid back into a slot 14*b* in the dispenser base 12*b*. Also, once the dispenser 10 is mounted to a wall mount, drip tray, or table stand described below, the cover 14*a* is locked in place (in a position as shown in FIG. 1*d*) and will not allow the plug 77 to accidentally be unplugged and, thus, prevents unintended power interruptions Turning to FIGS. 8 and 9, a wall mount 80 and a drip tray wall mount 90 are depicted. The wall mount 80 includes a bracket body 82 with four countersunk holes 84 configured to receive wall mounting screws. A pair of opposing channels 86 are formed on the sides of the bracket body 82 extending downwardly from a top of the bracket body 82 and are configured to engage the mounting bracket 14 on the rear of the base 12*b* of the dispenser 10. The mounting bracket 14 is supported on the wall mount 80 by a pair of protuberances 88 protruding from the lower end of the sides of the bracket body 82. A moveable locking tab 89 engages abutments 87 extending from the mounting bracket 14 of the dispenser 10 to releasably secure the dispenser 10 to the wall mount 80.

The drip tray wall mount 90 includes the wall mount 80 described above with an elongate drip tray arm 91 extending vertically downward there from to a laterally disposed drip tray 92. The drip tray 92 includes a circular disc shaped body 94 with a concave upper surface 93. A pair of raised rings 95 and 96 extends up from the concave upper surface 93 of the drip tray 92 to hold both 8 ml and 2 oz bottles 95*a* and 96*a* (see FIG. 10) in a correct position for filling. A dome cover release key-holder 97 is formed in the underside of the drip tray 92 (see FIG. 13) and has snap in clip that holds the dome cover release key while not in use. A recessed cable guide 98 is formed on the backside of the drip tray arm 91 for an AC/DC cable 78 to run in. The cable 78 is completely recessed, allowing the drip tray arm 91 to sit flush against a wall surface or table stand described below. The backside of the drip tray arm 91 also has three recessed sections for the application of double sided tape to adhere the drip tray arm 91 to a wall or similar flat surface. The recessed sections allow use of superior foam tape which is thick, but keeps the drip tray arm 91 close to wall for better clearance.

Figure 12:
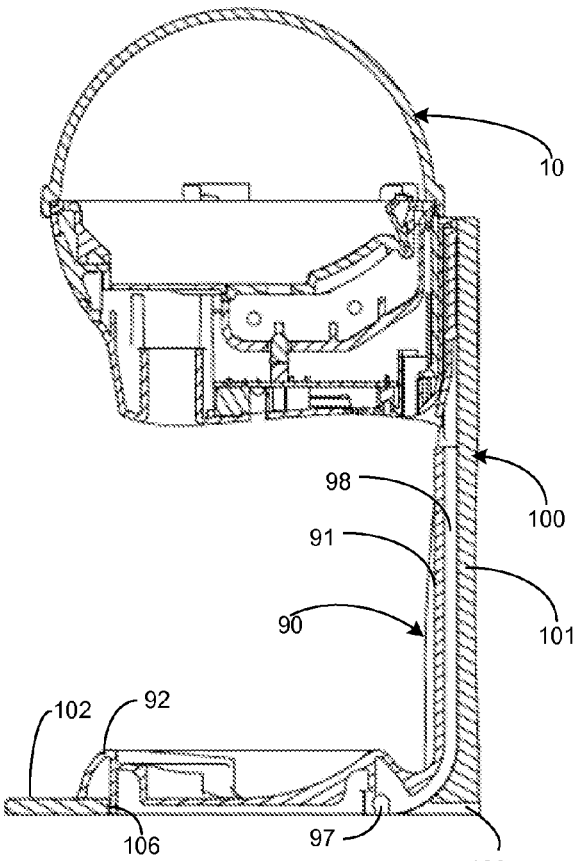
FIG. 12 is a vertical side cross section of the fluid dispenser without a fluid container disposed therein and coupled to the wall mount bracket with drip tray and a table stand.
Figure 13:
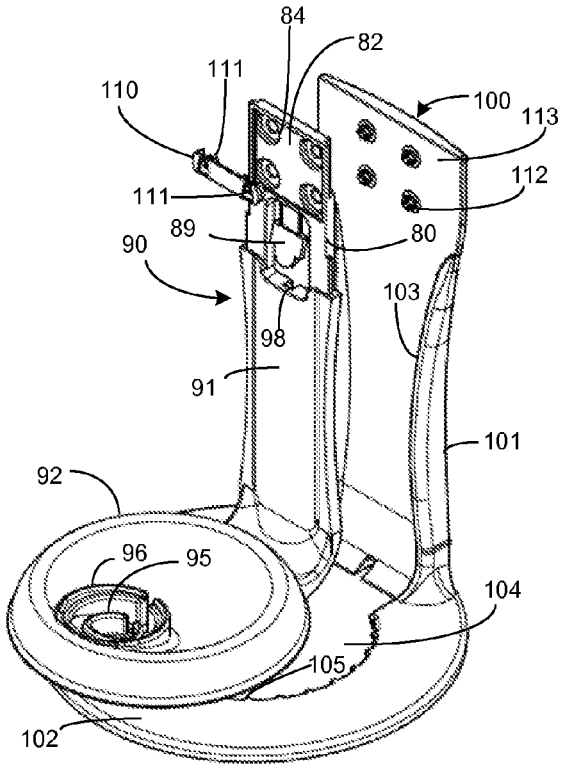
FIG. 13 is an exploded perspective view of the drip tray and table stand.

Turning to FIGS. 11*a*, 11*b*, 11*c* and 11*d*, the dispenser 10 is shown coupled to the drip tray wall mount 90. Alternatively, the drip tray wall mount 90 can be coupled to a table stand 100 as shown in FIGS. 12 and 13. As shown in FIGS. 12 and 13, the table stand 100 includes a support arm 101 vertically extending from an annular base 102. The base 102 of the table stand 100 has a circular hole 104 formed there through and sized to receive the underside of the body 94 of the drip tray 92. The table stand 100 includes inwardly projecting radial protuberances 105 formed about the periphery of the hole 104, a drip arm channel 103 formed in the support arm 101, and four snap in clips 112 positioned adjacent the top of the support arm 101 and projecting from a face of the support arm 101 to enable the drip tray 92 to easily snap together with the support arm 101 and base 102 for easy conversion to and from a table stand to drip tray wall mount. A locking bracket 110 having a pair of snap locking receptacles 111 is provided to releasably couple with a pair of the snap in clips 112 to prevent the drip tray from accidentally unsnapping from the table stand.

A cable guide 108 is formed in the base 102 and communicates with the cable guide 98 of the drip tray arm 91. The cable 78 is completely recessed, allowing the table stand 100 to sit flat against a table surface.

To open the fluid flow passageway 56*a*, the nozzle tip 58 is clipped or the knob 59 is twisted.

To prepare for the assembly and load the dispenser 10 for liquid dispensing, the upper hemisphere 11 is removed. If a locking pin 36 is provided, the locking pin 36 must first be disengaged. The upper hemisphere 11 is removed by twisting it counter clockwise to disengage the mating bayonet surfaces of the slots 71 and tabs 73 and pulled up vertically, thus exposing the interior of the dispenser 10. The cover 22*a* is lifted upwardly to expose the battery compartment 22, and four "D" size dry-cell batteries or the equivalent are then inserted into the compartment 22. The cover 22*a* is then returned to its normal position and a fluid containing bag 15 is installed by placing the bag 15 on the support piece 17 within the guide ring 29 with the downwardly extending extension tube or nozzle 16 of the bag 15 being inserted through the aperture 21*a* of the support piece 17 and the rigid support tube 20 as shown in FIGS. 2 and 3. When the extension tube 16 is firmly seated within rigid support tube 20 and locked in place with the locking tab 24 and stop 28, the upper hemisphere 11 may then be re-engaged and locked in place, thus securing the dispenser from atmospheric contaminates.

To operate the unit, one or both hands are positioned beneath exit port 31, with the fingers extending toward the center of lower hemisphere 12 such that they are in proximity to proximity sensor element 25. Proximity sensor element 25 recognizes the presence of the hand or hands and energizes the coil 46 of the solenoid 27 so as to cause the valve to open, thereby initiating dispensation of fluid. After a predetermined and adjustable period of time, the valve 50 closes and will not again open until proximity detector 25 senses the complete removal of the hands from the vicinity of the unit followed for a predetermined and adjustable period of time.

The adjustability in times maybe accomplished by conventional resistance-capacitance timing circuits that are well known in the art and may form a part of the circuitry on printed circuit board 23. Adjustment of the discharge interval and the reset interval may be made by conventional variable resistor controls positioned within the enclosure on or adjacent to circuit board 23, or they may be located within lower hemisphere 12 with an extension through the case of hemisphere 12 to the exterior to provide for exterior adjustment.

In a further embodiment, a kit can be provided to a user or purchaser comprising the dispenser 10, the wall mount 80, the drip tray wall mount 90 and the table stand 100. In addition, an AC/DC power plug 77 and cable 78 can also be included in the kit as well as the travel bottles 95*a* and 96*a*.

While the invention has been described in connection with preferred embodiments, it is not intended to limit the scope of the invention to the precise forms set forth; but on the contrary, it is intended to cover all adaptations and modifications that may be included within the spirit and scope of the invention as defined by the appended claims. Thus, for example, prevention of contact with hands may be accomplished with a projection guard or with a recess provided within the lower hemispherical section 12.

The terms and expressions used herein are employed as terms of description and not of limitation, and thus there is no intent in the use thereof to exclude any and all equivalents but on the contrary it is intended to include all such that fall within the inventive scope of the subject matter hereof.

The particular examples set forth herein are instructional and should not be interpreted as limitations on the applications to which those of ordinary skill are able to apply the systems and methods described herein. Modifications and other uses are available to those skilled in the art which are encompassed within the spirit of the invention as defined by the scope of the appended claims.

What is claimed is:

1. A sanitary liquid dispenser device comprising a dispenser for dispensing a liquid, a drip tray wall mount couplable to a wall and coupled to the dispenser, wherein the drip tray wall mount includes a drip tray and a drip tray arm extending vertically up from the drip tray, and a table stand releasably coupled to the drip tray wall mount, wherein the table stand includes a base and a support arm extending vertically up from the base, wherein the support arm includes a recess to releasably couple to the drip tray arm of the drip tray wall mount.

2. The sanitary liquid dispenser of claim 1 wherein the drip tray wall mount further comprises a pair of opposing channels formed on the sides of a bracket body extending downwardly from a top of the bracket body and configured to engage a mounting bracket on the rear of the dispenser.

3. The sanitary liquid dispenser of claim 1 wherein a drip tray of the drip tray wall mount comprises a body with a concave upper surface.

4. The sanitary liquid dispenser of claim 1 wherein the dispenser comprising a spherical housing having a lower hemisphere and a detachable upper hemisphere comprising a translucent dome, the lower hemisphere including a downwardly extending base with a dispensing port.

5. The sanitary liquid dispenser of claim 4 wherein the dispenser comprises an LED configured to illuminate a solution bag positioned within the lower hemisphere and the inner surface of the translucent dome.

6. The sanitary liquid dispenser of claim 5 wherein the drip tray comprises a circular disc shaped body with a concave upper surface.

7. The sanitary liquid dispenser of claim 1 further comprising a proximity detector mounted in a lower part of the dispenser for detecting the proximity of an object there beneath when near the proximity detector and for producing an electrical signal indicative of the detection of an object.

8. The sanitary liquid dispenser of claim 7, further comprising a fluid reservoir comprising a disposable deformable bag, the bag having a nozzle projecting downwardly from the bag and including a valve comprising a conductive sleeve, a valve gate coupled to the sleeve, and a valve seat operably engageable with the valve gate; and a control circuit coupled to the proximity detector and a valve-actuator and configured to cause the valve actuator to open the valve for a predetermined time interval thereby to permit a predetermined quantity of fluid to flow from the bag.

9. The sanitary liquid dispenser of claim 8 further including an adjusting means for adjusting a time interval.

10. The sanitary liquid dispenser of claim 1 wherein the wall mount drip tray comprises a bracket body, the elongate drip tray arm extending downwardly from the bracket body to the laterally disposed drip tray.

11. A sanitary liquid dispenser device comprising a dispenser for dispensing a liquid, a drip tray wall mount couplable to a wall and coupled to the dispenser, wherein the drip tray wall mount includes a bracket body and a moveable locking tab extending from the bracket body and releasably securing the dispenser to the drip tray wall mount, and a table stand releasably coupled to the drip tray wall mount.

12. The sanitary liquid dispenser of claim 11 wherein the dispenser including a housing that is spherical with a lower hemisphere and a detachable upper hemisphere comprising a translucent dome, the lower hemisphere including a downwardly extending base with a dispensing port.

13. The sanitary liquid dispenser of claim 12 wherein the dispenser comprises a proximity detector mounted in a lower part of the housing for detecting the proximity of an object there beneath when near the proximity detector and for producing an electrical signal indicative of the detection of an object.

14. The sanitary liquid dispenser of claim 13 wherein the dispenser comprises a solenoid operably coupled to the proximity detector and responsive to said electrical signal for assuming a valve actuating condition.

15. A sanitary liquid dispenser device comprising a dispenser for dispensing a liquid, a drip tray wall mount couplable to a wall and coupled to the dispenser, wherein the drip tray wall mount comprises a drip tray with a concave upper surface and a pair of raised rings extending up from the concave upper surface of the drip tray, and a table stand releasably coupled to the drip tray wall mount.

16. The sanitary liquid dispenser of claim 15 wherein the drip tray wall mount includes a drip tray arm extending vertically up from the drip tray.

17. The sanitary liquid dispenser of claim 15 wherein the table stand comprises a support arm vertically extending from an annular base, wherein the support arm and annular base releasably couple to the drip tray and a drip tray arm of the drip tray wall mount.

* * * * *